US009556700B2

(12) United States Patent
Shek et al.

(10) Patent No.: US 9,556,700 B2
(45) Date of Patent: Jan. 31, 2017

(54) DOWNHOLE SEALING ASSEMBLY

(71) Applicant: CDI Energy Products, Humble, TX (US)

(72) Inventors: Lee Shek, Houston, TX (US); Hung Thai Nguyen, Manvel, TX (US)

(73) Assignee: CDI ENERGY PRODUCTS, Humble, TX (US)

( * ) Notice: Subject to any disclaimer, the term of this patent is extended or adjusted under 35 U.S.C. 154(b) by 331 days.

(21) Appl. No.: 14/215,880

(22) Filed: Mar. 17, 2014

(65) Prior Publication Data

US 2014/0262209 A1 Sep. 18, 2014

Related U.S. Application Data

(60) Provisional application No. 61/791,983, filed on Mar. 15, 2013.

(51) Int. Cl.
*E21B 33/10* (2006.01)
*E21B 33/128* (2006.01)

(52) U.S. Cl.
CPC ..... *E21B 33/10* (2013.01); *E21B 33/128* (2013.01)

(58) Field of Classification Search
USPC ..... 166/116
See application file for complete search history.

(56) References Cited

U.S. PATENT DOCUMENTS

| | | | | |
|---|---|---|---|---|
| 2,246,881 | A * | 6/1941 | Fisher | E21B 33/128 166/203 |
| 4,141,413 | A * | 2/1979 | Morris | E21B 33/1295 166/120 |
| 5,676,384 | A * | 10/1997 | Culpepper | E21B 33/1216 277/342 |
| 6,666,276 | B1 * | 12/2003 | Yokley | E21B 23/01 166/118 |
| 7,971,640 | B2 * | 7/2011 | Freyer | E21B 33/128 166/196 |
| 2004/0182582 | A1 * | 9/2004 | Bosma | E21B 43/103 166/387 |
| 2008/0023193 | A1 * | 1/2008 | O'Brien | E21B 33/1208 166/179 |
| 2012/0298349 | A1 * | 11/2012 | Braekke | E21B 33/128 166/118 |
| 2014/0262209 | A1 * | 9/2014 | Shek | E21B 33/10 166/116 |

* cited by examiner

*Primary Examiner* — Taras P Bemko
(74) *Attorney, Agent, or Firm* — Shumaker, Loop & Kendrick, LLP

(57) ABSTRACT

An expandable downhole sealing assembly in which an axial setting force is applied to radially compress and self-energize an expanding element such that stored radial forces in the expanding element effect and maintain a seal thereafter. The sealing assembly can be used to provide a seal between a casing and a mandrel in a well, among other applications.

20 Claims, 5 Drawing Sheets

DOWNHOLE SEALING ASSEMBLY

CROSS-REFERENCE TO RELATED APPLICATION

This application claims priority from U.S. Provisional App. No. 61/791,983 filed Mar. 15, 2013, the entirety of which is incorporated by reference herein.

TECHNICAL FIELD AND BACKGROUND OF THE INVENTION

The present invention relates generally to sealing assemblies used in the oil and gas industry, and more particularly, to expandable downhole sealing assemblies in which an axial setting force is applied to radially compress and self-energize an expanding element such that stored radial forces in the expanding element effect and maintain a seal thereafter.

Downhole packers are well known in the oil and gas industry for sealing an annulus between various weight casings and mandrels at different underground locations in an oil well, for example, to exploit different production zones. Conventional downhole packers include multi-element elastomeric packers (see FIG. 7), packers including a single elastomeric element having metal or mesh back-ups (see FIG. 8), and inflatable packers. Elastomeric sealing elements are generally restricted for use in applications up to about 450° F., while high temperature and pressure applications require flexible or expanded graphite.

Packers having elastomeric sealing elements typically require a large axial setting force to deform the sealing element radially outward to reach the interior of the casing. Typically, the greater the setting force the more energy transferred radially outward. Once set, internal stresses within the sealing element work against the packer as lost energy, thus an axial maintenance force is required to resist the elastomeric memory of the element. As a result, the packer is not "self-energizing," and will leak at a pressure higher than its equilibrium internal pressure without any sign of extrusion.

Geothermal packers used in high temperature applications (e.g., up to about 650° F.) can include braided graphite packing elements or compressed flexible graphite elements. These packers also require large axial setting forces to deform the element to reach the interior of the casing. One problem associated with the use of flexible graphite elements is that they are fragile, and thus susceptible to damage when the tool is lowered into the well. To protect the flexible graphite elements from damage during installation, the elements are typically covered with an elastomeric shell, which not only increases the complexity of the assembly, but also introduces the problems associated with elastomeric memory as discussed above.

Inflatable packers utilize air or other fluid injected into an expandable element to expand the outer shell to reach the interior of the casing. In inflatable packers, the inflation pressure must be higher than the system pressure in order to maintain a positive seal. Thus, like the other conventional packers discussed above, inflatable packers are not self-energizing. Additionally, any axial movement of the packer or the anchoring stop will relax the packer and reduce the sealing force accordingly. Further, when the temperature increases after setting, the element tends to expand, which further deforms the back-up system to create more gland volume or room. Further, changes in internal pressure as a result of thermal cycling affect the sealability.

Accordingly, what is needed is a self-energizing packer that overcomes the disadvantages of prior art assemblies in that the packer is structurally simple, requires a minimum setting force, obviates the need for axial maintenance forces, and is suitable for use with elastomeric, thermoplastic and graphitic elements, among other advantages.

BRIEF SUMMARY OF THE INVENTION

In one aspect, a sealing assembly for use in the oil and gas industry is provided herein and generally includes a sealing ring (i.e., an "expanding element") and a deflecting ring, wherein an axial setting force is applied to the deflecting ring to radially deflect and compress the sealing ring to force the axially aligned rings into an arrangement in which the sealing ring is radially outside of the deflecting ring. By radially compressing the sealing ring and causing it to deform, in contrast to conventional packers arrangements in which a sealing element is axially compressed, stored forces in the sealing ring work to effect and maintain the seal after the setting force is removed.

In another aspect, the sealability of the sealing ring is independent of the setting force.

In yet another aspect, the sealing ring is radially compressed between the deflecting element and the interior of the casing when expanded downhole.

In yet another aspect, the cross-section of the sealing ring increases in the axial direction and decreases in the radial direction from the unset to the set configurations.

In yet another aspect, the deflecting ring defines a ramped surface at one end thereof facing in the direction of the sealing ring and configured for radially displacing the sealing ring upon axial movement of the deflecting ring in the direction of the sealing ring.

In yet another aspect, the deflecting ring defines a first surface arranged at an angle to the interior wall of the casing, and a second surface arranged substantially parallel to the interior wall of the casing, wherein, upon axial movement of the deflecting ring in the direction of the sealing ring, at least a portion of the sealing ring is forced passed the first surface and comes to rest over the second surface such that a portion of the sealing ring and the deflecting ring overlap in the axial direction.

In yet another aspect, after the sealing assembly is set (i.e., "expanded"), the portion of the sealing ring axially overlapping the second surface of the deflecting ring is radially compressed to a greater degree than portions of the sealing ring axially overlapping the first surface.

In yet another aspect, a portion of the second surface of the deflecting ring is recessed radially inward to receive a portion of the deformed sealing ring therein when the sealing ring and the deflecting ring overlap in the axial direction.

In yet another aspect, the sealing ring is resiliently deformable and assumes a final shape after being set.

In yet another aspect, the sealing ring retains its radially compressed shape and set height after the setting force is removed.

In yet another aspect, the sealing ring is radially compressed such that its cross-section decreases when set.

In yet another aspect, the sealing ring includes at least one of elastomeric, thermoplastic, and graphitic materials.

In yet another aspect, axial system pressure in translated into radial force to self-energize the sealing ring.

In another aspect, the sealing ring is made from PTFE (e.g., virgin or filled), and is suitable for use in temperature applications from about −50° F. to about 650° F., as well as within harsh chemical environments.

To achieve the forgoing and other aspects and advantages, in a first embodiment the present invention provides a sealing assembly for sealing an annulus in a downhole application including a sealing ring and a deflecting ring axially aligned between axially opposed mesh back-ups, each of the sealing ring and the deflecting ring defining a first ramped end, the first ramped ends of the sealing ring and the deflecting ring arranged facing each other such that an axial set force applied to the deflecting ring deflects the sealing ring radially outward forcing the sealing ring into a side-by-side arrangement with the deflecting ring to fill and seal the annulus.

In a further embodiment, the sealing ring is deformable such that when the sealing ring is forced radially outward, the sealing ring extends axially and compresses radially.

In a further embodiment, the sealing ring has a larger cross-section before the axial set force is applied than after the axial set force is applied.

In a further embodiment, the deflecting ring defines a recess along the length thereof for receiving a portion of the sealing ring therein when the sealing assembly is in an expanded configuration.

In a further embodiment, each of the sealing ring and the deflecting ring define a second ramp spaced from their respective first ramped end, wherein the second ramp and the ramped end of each of the sealing ring and the deflecting ring are parallel such that when the set force is applied, the first ramped end of the sealing ring slides against and passes the second ramp of the deflecting ring, and the first ramped end of the deflecting ring slides against and passes the second ramp of the sealing ring, in the axial direction.

In a further embodiment, the sealing ring defines a second ramped end adjacent the mesh back-up at a 35 degree angle to the longitudinal axis of the sealing assembly, and the deflecting ring defines a second ramped end adjacent the mesh back-up at a 55 degree angle to the longitudinal axis of the sealing assembly.

In a further embodiment, the sealing assembly includes an o-ring retained against an inner wall of the deflecting ring.

In another embodiment, provided herein is a sealing assembly for sealing an annulus in a downhole application including a sealing ring and a deflecting ring axially aligned between axially spaced mesh back-ups, each of the sealing ring and the deflecting ring defining a first ramped end and a second ramp spaced from the first ramped end, the sealing ring and the deflecting ring arranged such that, when an axial set force is applied to the deflecting ring, the first ramped end of the deflecting ring slides against and passes the second ramp of the sealing ring and the first ramped end of the sealing ring slides against and passes the second ramp of the deflecting ring to deflect the sealing ring radially outward to force the sealing ring into an arrangement in which the sealing ring at least partially overlaps the deflecting ring to seal the annulus.

In a further embodiment, the sealing ring further defines a second ramped end at a 35 degree angle to a longitudinal axis of the sealing assembly, and the deflecting ring defines a second ramped end at a 55 degree angle to the longitudinal axis of the sealing assembly.

In yet another embodiment, provided herein is a sealing assembly for sealing an annulus in a downhole application including a deformable sealing ring and a rigid deflecting ring axially aligned between axially spaced mesh back-ups, each of the deformable sealing ring and the rigid deflecting ring defining a first ramped end, the first ramped ends of the deformable sealing ring and the rigid deflecting ring arranged facing each other such that an axial set force applied to the rigid deflecting ring deflects the deformable sealing ring radially outward relative to a longitudinal axis of the sealing assembly, axially lengthens the deformable sealing ring, and radially compresses the deformable sealing ring to force the deformable sealing ring into a side-by-side arrangement with the rigid deflecting ring to fill the annulus.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention.

BRIEF DESCRIPTION OF THE DRAWINGS

Features, aspects and advantages of the present invention are better understood when the following detailed description of the invention is read with reference to the accompanying drawings, in which.

DETAILED DESCRIPTION OF THE INVENTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Figure 1:
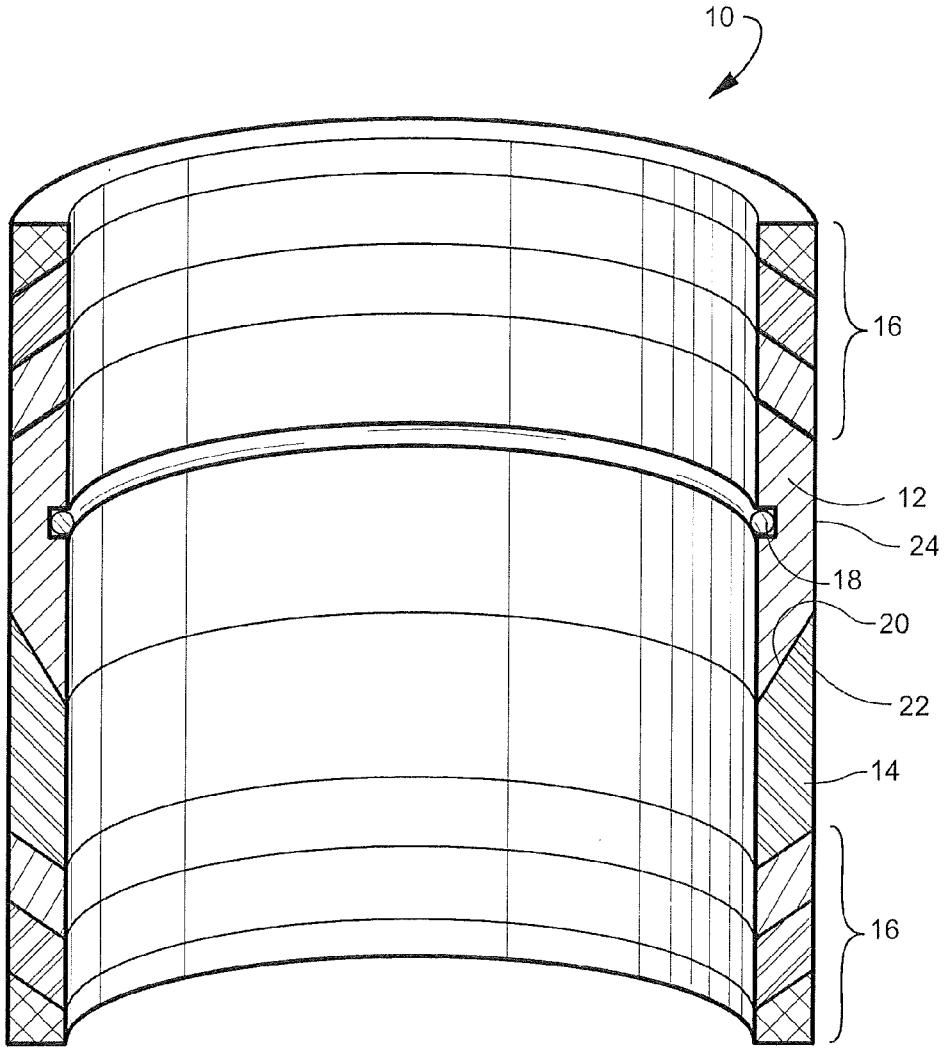
FIG. 1 is an axial cross-section of a sealing assembly according to a first embodiment of the invention.

Referring to FIG. 1, a first embodiment of a sealing assembly (e.g., a "downhole packer") suitable for use in downhole applications in the oil and gas industry is shown generally at reference numeral 10. The sealing assembly 10, shown prior to being set (i.e., in an "unexpanded" configuration), generally includes a deflecting ring 12 and a sealing ring 14 arranged between (i.e., sandwiched) axially opposed back-up systems 16. The deflecting ring 12 is positioned on the "stroking" or dynamic side of the assembly 10, and moves with a gauge ring to axially expand the sealing ring 14, as described in detail below. An O-ring 18 may be retained in an annular slot along the interior wall of the deflecting ring 12 that functions to further effect a seal between the deflecting ring 12 and the outer wall of a cylindrical mandrel (see FIG. 3).

The deflecting ring 12 can be made from any suitable material or combination of materials including, but not limited to, PTFE (filled or virgin), PPS, PEEK, elastomer, thermoplastic material or metal/alloy. The back-up systems 16 can be made from any material or combination of materials including, but not limited to, Sintermesh™, Unsintermesh™, wire mesh, graphoil with wire mesh, of the like, with the back-up systems being capable of expanding to close extrusion gaps between the gauge ring and the casing interior. The sealing ring 14, also referred to herein as the "expanding element," can be made from any material or combination of materials including, but not limited to, elastomeric, thermoplastic and graphitic materials. The sealing ring 14 may be a machined or molded elastomeric element suitable for use in applications up to about 450° F. Applications above about 450° F. may require thermoplastic PTFE compounds and/or graphitic elements.

The deflecting ring 12 is an annular ring defining a ramped surface 20 (i.e., a surface at an angle to the axial direction) at one end thereof facing in the direction of and in physical contact with a corresponding ramped surface 22 of the sealing ring 14. During setting, the ramped surfaces 20, 22 of the components slide passed one another such that the angular relationship therebetween causes at least a portion of the deflecting ring 12 to slide beneath at least a portion of the sealing ring 14, thereby deflecting at least a portion of the sealing element radially outward. As used herein, the term "axial" or "axial direction" is intended to mean in the direction along the axis of the well bore, casing, mandrel or sealing element. As used herein, the term "radial," "radially" or "radial direction" is intended to mean in the direction from the center of the well bore, casing, mandrel or sealing element outward, or from the circumference of the well bore, casing or sealing element inward.

Figure 4:
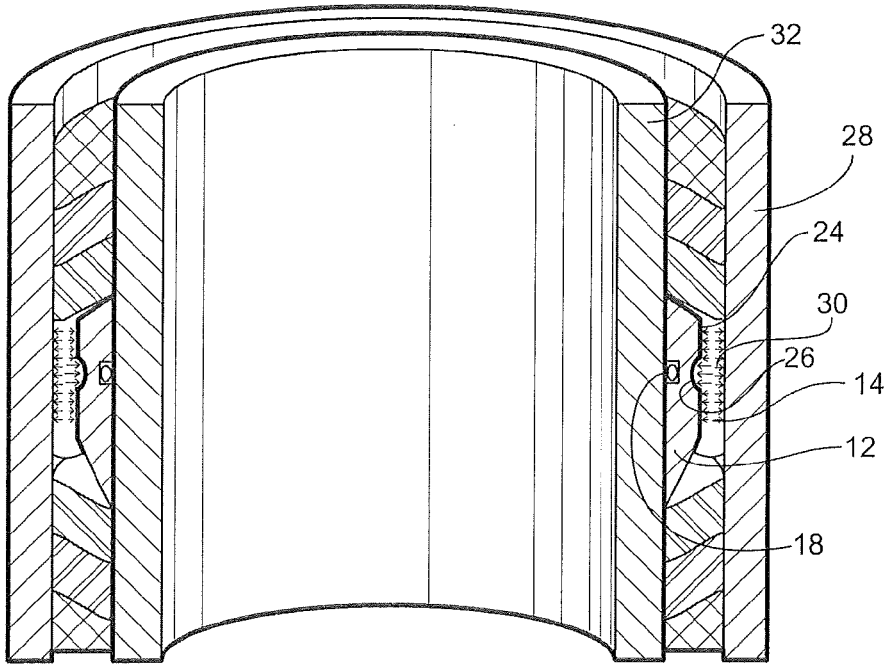
FIG. 4 is an axial cross-section of a downhole sealing assembly having a recessed formed in the deflecting element of the assembly, and shown expanded downhole.

The deflecting ring 12 further defines a substantially flat surface 24 or "table" adjacent the ramped surface 20, that at least partially slides beneath the sealing ring 14 when the sealing assembly 10 is in its expanded configuration. Surface 24 is arranged substantially parallel to the axial direction. Referring to FIG. 4, surface 24 may optionally include at least one shaped recess 26 positioned along the length thereof for receiving a portion of the deformed sealing ring 14 therein when the packer is expanded. The receipt of a portion of the sealing ring 14 in the recess 26 further resists relative axial movement between the sealing ring and the deflecting ring when the packer is expanded.

Figure 3:
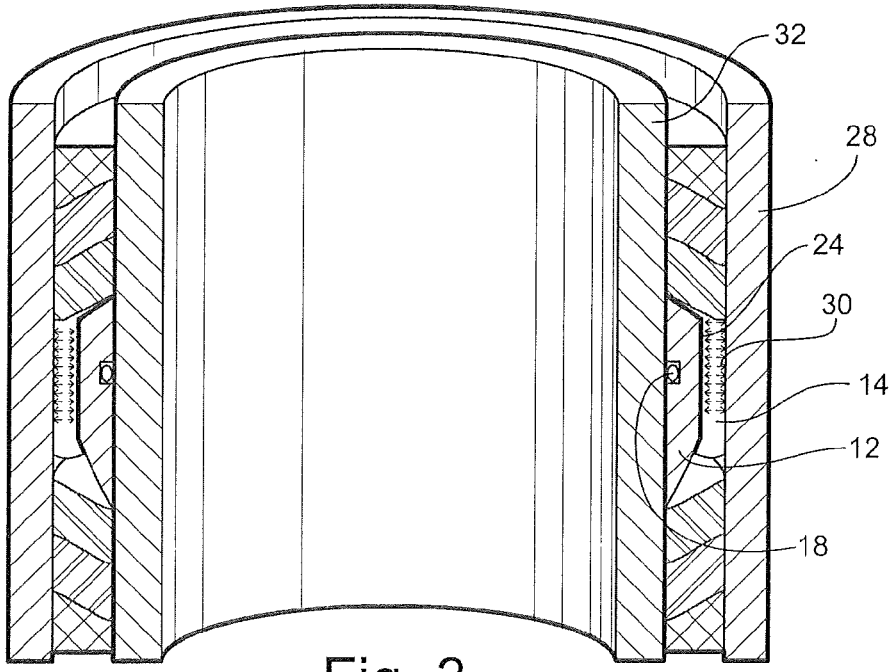
FIG. 3 is an axial cross-section of the sealing assembly of FIG. 1 shown expanded downhole.

Referring to FIGS. 3 and 4, the sealing assembly 10 with and without the recess 26 is shown in the expanded configuration. When the axial set force is applied, the deflecting ring 12 moves axially in the direction of the sealing ring 14, thus forcing the sealing ring radially outward. As the deflecting ring 12 continues to be forced in the direction of the sealing ring 14, the space constraints between the casing 28 and the deflecting ring force the deformable sealing ring to radially compress and axially expand to fill the annulus (i.e., "gap") between the deflecting ring and the interior wall of the casing. Because the sealing ring's starting radial cross-section is greater than the space between the deflecting ring 12 and the interior wall of the casing 28, the sealing ring 14 is radially compressed or "squeezed," with predetermined maximum and minimum compression based on the casing weight tolerance. At the same time, the back-up system 16 is activated and expanded until it reaches the interior wall of the casing 28, assuring zero extrusion gaps.

When set, the sealing ring 14 and surface 26 overlap in the axial direction. In other words, when the sealing assembly is expanded, the sealing ring 14 and the deflecting ring 12 are side-by-side, with the sealing ring 14 radially outward of the deflecting ring 12. The extent of overlap depends upon the starting thickness of the sealing ring 14, the size of the annulus to be filled, the length of the second surface 26, etc. Once set, because the sealing ring 14 is radially compressed, the elastic memory of the material wants to return to its original cross-section (i.e., wants to radially expand). This compressive strength acts on the deflecting ring 12 and the interior wall of the casing 28, illustrated by the small force arrows 30, to create a high contact load on the sealing ring 14, thus providing a "self-energized" seal between the deflecting ring 12 and the interior of the casing 28.

The seal achieved as a result of the radial compression of the sealing ring 14 and the O-ring 18 cooperate to achieve a high-pressure seal between the interior of the casing 28 and exterior of the mandrel 32. Removing or relaxing the setting force and/or removing the anchoring system has no appreciable effect on the seal performance once set. Additionally, the low end of a thermal cycle will not cause an appreciable reduction of the sealing ring's 14 internal stress, and consistent sealability can be maintained similar to the original setting.

Figure 2:
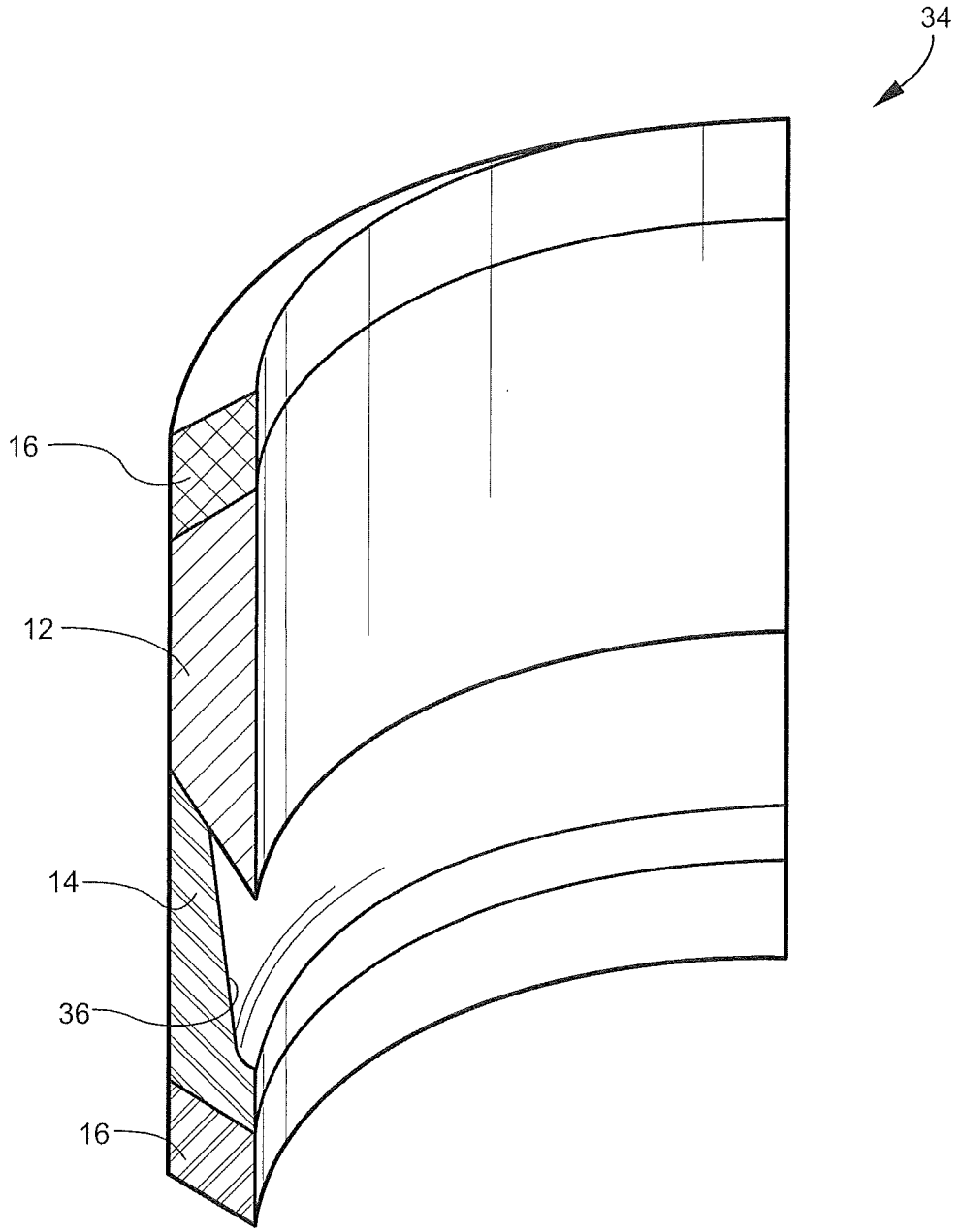
FIG. 2 is an axial cross-section of a geothermal sealing assembly according to an embodiment of the invention.

Referring to FIG. 2, an embodiment of a geothermal packer for high temperature applications is shown generally at reference numeral 34. Because of the high temperatures in such applications, the sealing ring 14 may be made from thermoplastic PTFE compounds or graphitic elements. In this embodiment, the sealing ring 14 defines a tapered portion 36 having a ramped surface that tapers in thickness in the direction of the deflecting ring 12. In use, when the axial set force is applied, the deflecting ring 12 moves in the direction of the sealing ring 14, thereby deflecting the sealing ring 14 radially outward, and forcing the sealing ring 14 into the gap between the deflecting ring and the interior wall of the casing.

When set or "expanded," the sealing ring 14 and the deflecting ring 12 overlap in the axial direction over the length of the tapered portion 36. At the same time, the back-up system 16 is activated and expanded until it reaches the interior wall of the casing, assuring zero extrusion gaps. The compressive forces in the sealing ring 14 urge against the deflecting ring 12 and the interior wall of the casing to create a high contact load on the sealing ring 14, thus achieving a seal between the deflecting ring and the interior wall of the casing. The back-up requirements in the geothermal packer may be relaxed due to the lower pressure as compared to the embodiment described above.

Figure 5:
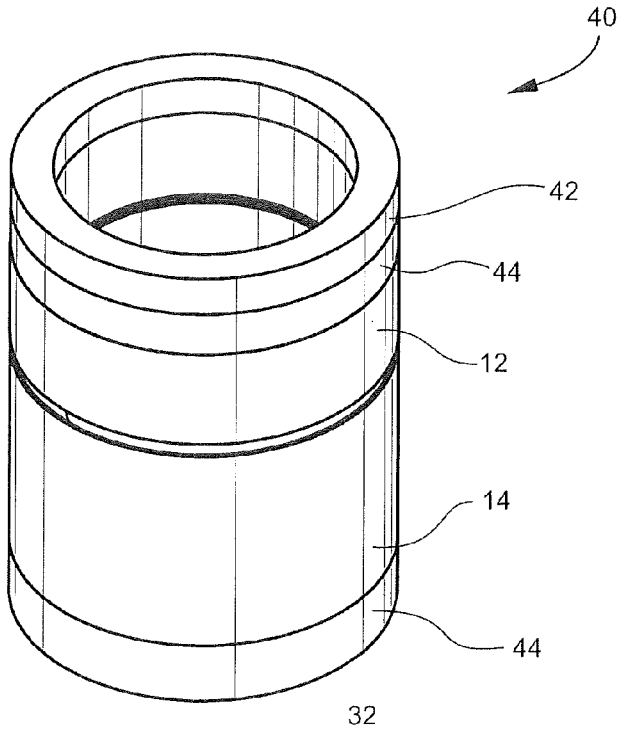
FIG. 5 is a perspective view of another embodiment of a sealing assembly.
Figure 6:
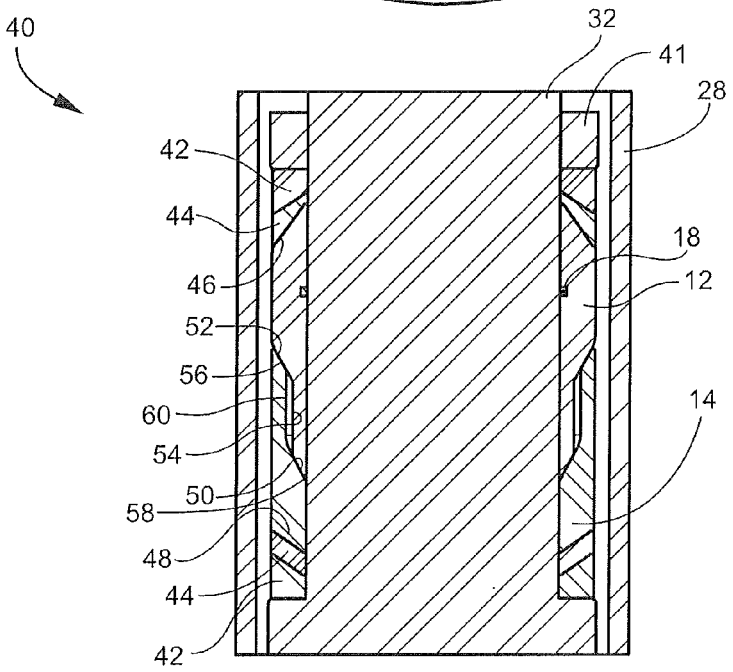
FIG. 6 is an axial cross-section of the sealing assembly of FIG. 5.
Figure 7:
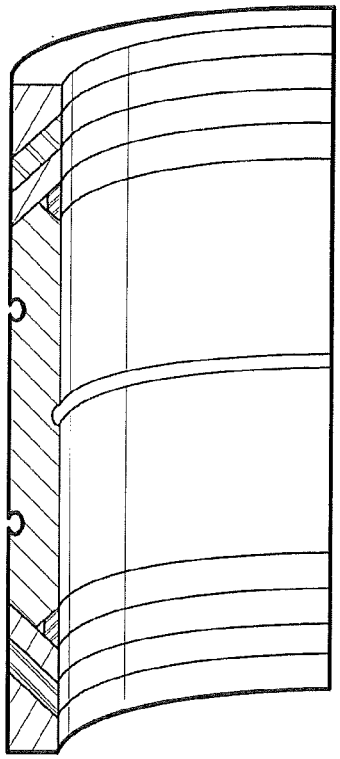
Fig. 7 Prior Art
FIG. 7 is an axial cross-section of a prior art sealing assembly.
Figure 8:
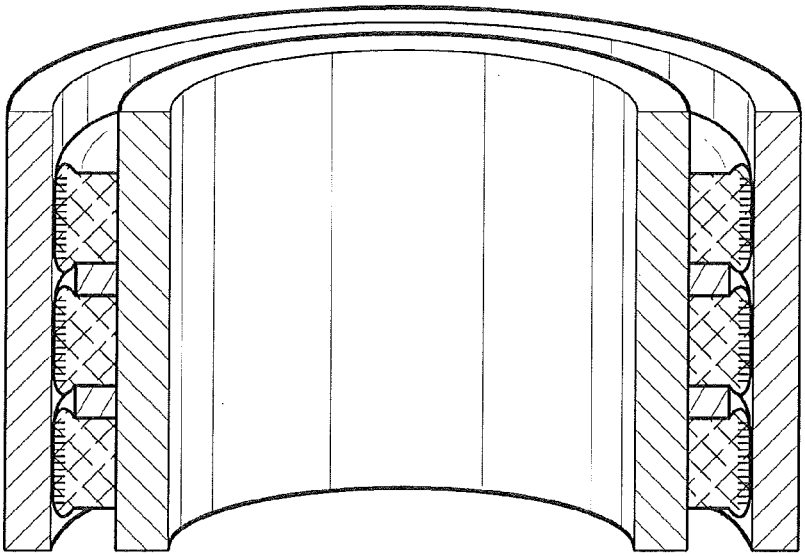
Fig. 8 Prior Art
FIG. 8 is an axial cross-section of another prior art sealing assembly including multiple, spaced sealing elements.

Referring to FIGS. 5 and 6, another embodiment of a sealing assembly is shown generally at reference numeral 40. The sealing assembly 40, shown in an unexpanded configuration, generally includes an expanding element, a deflecting element, and back-ups at both ends. Specifically, sealing assembly 40 includes a deflecting ring 12 (or "ramping ring") and a sealing ring 14 arranged between axially opposed back-up systems 16. The deflecting ring 12 is positioned on the "stroking" or dynamic side of the assembly 40, and moves with the gauge ring 41 to deflect the sealing ring 14 radially outward in use. An O-ring 18 may be disposed along the interior wall of the deflecting ring 12 that functions to achieve a seal between the deflecting ring 12 and the outer wall of the cylindrical mandrel 32.

The deflecting ring 12 can be made from any suitable material or combination of materials including, but not limited to, PTFE (filled or virgin), PPS, PEEK, elastomer, thermoplastic material or metal/alloy. The 'upper' and 'lower' back-up systems 16 can be made from any material or combination of materials including, but not limited to, Sintermesh™, Unsintermesh™, steel mesh, wire mesh, graphoil with wire mesh, or the like, with the back-up systems being capable of expanding to close extrusion gaps between the gauge ring and the casing interior. As shown, the 'upper' and 'lower' back-ups each include Sintermesh™ 42 adjacent Unsintermesh™ 44. The 'upper' and 'lower' Sintermesh™ components 42 may be asymmetrical and have modified shapes. For example, the angle of face 46 of the deflecting ring 12 immediately adjacent to and facing in the direction of 'upper' Unsintermesh™ component 44 may be 55 degrees, whereas the angle of face 48 of the sealing ring 14 immediately adjacent to and facing in the direction of 'lower' Unsintermesh™ component 44 may be 35 degrees.

In comparison to the "single-ramp" arrangement shown in FIG. 1, sealing assembly 40 is a "double ramp" arrangement, resulting in a longer axial seal capable of withstanding higher pressures. Specifically, the deflecting ring 12 is an annular ring defining first and second ramps 50, 52 (i.e., at an angle to the axial direction) spaced by an intermediate flat 54 (i.e., parallel to the axial direction). The first and second ramps 50, 52 face and slide in physical contact against corresponding ramps 56, 58 of the sealing ring 14, also spaced by a flat 60. During setting, ramps 50 and 58, as well as ramps 52 and 56, slide passed one another such that the thin-walled portion of the sealing ring 14 is deflected radially outward of the thick-walled portion of the deflecting ring 12, and the thin-walled portion of the deflecting ring 12 is forced radially inward of the thick-walled portion of the sealing ring 14, and wherein the respective portions overlap in the axial direction. When set, the deflecting ring 12 and sealing ring 14 thus effectively interlock based on their predetermined shapes. The larger cross-section of the 'overlapped' deflecting ring 12 and sealing ring 14 as compared to the gap between the mandrel and inner wall of the casing forms the seal.

The foregoing description provides embodiments of the invention by way of example only. It is envisioned that other embodiments may perform similar functions and/or achieve similar results. Any and all such equivalent embodiments and examples are within the spirit and scope of the present invention and are intended to be covered by the appended claims.

What is claimed is:

1. A sealing assembly for sealing an annulus in a downhole application, comprising:

a sealing ring and a deflecting ring axially aligned between axially opposed mesh back-ups, the sealing ring having a first ramped end angled relative to a longitudinal axis and the deflecting ring having axially-opposed first and second ramped ends angled relative to a longitudinal axis and an intermediate portion having an outer wall adapted to be oriented parallel to an outer wall of a cylindrical mandrel, wherein the first ramped end of the sealing ring and the first ramped end of the deflecting ring are arranged facing each other such that an axial set force applied to the deflecting ring in a longitudinal direction deflects the sealing ring radially outward forcing the sealing ring into a radially side-by-side arrangement with the deflecting ring wherein the sealing ring deforms to cover the outer wall and portions of the first and second ramped ends of the deflecting ring to fill and seal the annulus.

2. The sealing assembly of claim 1, wherein the sealing ring is deformable such that when the sealing ring is forced radially outward, the sealing ring extends axially and compresses radially.

3. The sealing assembly of claim 1, wherein the sealing ring has a larger cross-section before the axial set force is applied than after the axial set force is applied.

4. The sealing assembly of claim 1, wherein a recess is provided along a length of the outer surface for receiving a portion of the sealing ring therein when the sealing assembly is in an expanded configuration.

5. The sealing assembly of claim 1, wherein the deflecting ring has an intermediate ramp between the first and second ramped ends thereof and the sealing ring has a second ramped end and an intermediate ramp between the first and second ramped ends thereof, and wherein the intermediate ramps of the deflecting ring and the sealing ring and the first ramped end of the sealing ring and the first ramped end of the deflecting ring are all arranged parallel to each other such that when the set force is applied, the first ramped end of the sealing ring slides against and passes the intermediate ramp of the deflecting ring, and the first ramped end of the deflecting ring slides against and passes the intermediate ramp of the sealing ring, in the axial direction.

6. The sealing assembly of claim 1, wherein the second end of the sealing ring is at a 35 degree angle to a longitudinal axis of the sealing assembly, and the second end of the deflecting ring is at a 55 degree angle to the longitudinal axis of the sealing assembly.

7. The sealing assembly of claim 1, further comprising an O-ring retained against in a circumferential recess formed around an inner wall of the intermediate portion of the deflecting ring.

8. The sealing assembly of claim 1, wherein the deflecting ring is constructed from one or more of PTFE, PPS, PEEK, elastomeric material, thermoplastic material, metal and metal alloy.

9. The sealing assembly of claim 1, wherein the mesh back-ups are constructed from one or more of steel mesh, wire mesh, and graphoil with wire mesh.

10. The sealing assembly of claim 1, wherein the sealing ring is constructed from one or more of elastomeric, thermoplastic and graphitic materials.

11. A sealing assembly for sealing an annulus in a downhole application, comprising:

a sealing ring and a deflecting ring axially aligned between axially spaced mesh back-ups, each of the sealing ring and the deflecting ring defining axially-opposed first and second ramped ends angled relative to a longitudinal axis, the first and second ramped ends of the deflecting ring spaced apart by an intermediate portion, the sealing ring and the deflecting ring arranged such that, when an axial set force is applied to the deflecting ring in a longitudinal direction, the first ramped end of the deflecting ring slides past the second ramped end of the sealing ring and the first ramped end of the sealing ring slides past the second ramped end of the deflecting ring to deflect the sealing ring radially outward to force the sealing ring into a radial arrangement in which the sealing ring overlaps the intermediate portion and portions of the first and second ramped ends of the deflecting ring to seal the annulus.

12. The sealing assembly of claim 11, wherein one of the first and second ramped ends of the sealing ring is at a 35 degree angle to a longitudinal axis of the sealing assembly, and one of the first and second ramped ends of the deflecting ring is at a 55 degree angle to the longitudinal axis of the sealing assembly.

13. The sealing assembly of claim 11, further comprising an O-ring retained in a circumferential recess in an inner wall of the intermediate portion of the deflecting ring.

14. The sealing assembly of claim 11, wherein the spaced mesh back-ups comprise one or more of steel mesh, wire mesh, and graphoil with wire mesh.

15. A sealing assembly for sealing an annulus in a downhole application, comprising:

a deformable sealing ring and a rigid deflecting ring axially aligned between axially spaced mesh back-ups, each of the deformable sealing ring and the rigid deflecting ring having axially-opposed first and second ramped ends angled relative to a longitudinal axis, the first and second ramped ends of the rigid deflecting ring spaced apart by an intermediate portion, the first ramped of each of the deformable sealing ring and the rigid deflecting ring arranged facing each other such that an axial set force applied to the rigid deflecting ring in a longitudinal direction deflects the deformable sealing ring radially outward relative to a longitudinal axis of the sealing assembly, axially lengthens the deformable sealing ring, and radially compresses the deformable sealing ring to force the deformable sealing ring into a radial side-by-side arrangement with the rigid deflecting ring in which the deformable sealing ring covers the intermediate portion and portions of the first and second ramped ends of the rigid deflecting ring to fill the annulus.

16. The sealing assembly of claim 15, wherein the deformable sealing ring has a larger cross-section before the axial set force is applied than after the axial set force is applied.

17. The sealing assembly of claim 15, wherein the rigid deflecting ring has a recess formed in an outer wall of the intermediate portion along a length thereof for receiving a portion of the deformable sealing ring therein when the sealing assembly is in an expanded configuration.

18. The sealing assembly of claim 15, further comprising an O-ring retained in a circumferential recess in an inner wall of the intermediate portion of the rigid deflecting ring.

19. The sealing assembly of claim 15, wherein the deflecting ring is constructed from one or more of PTFE, PPS, PEEK, elastomeric material, thermoplastic material, metal and metal alloy.

20. The sealing assembly of claim 15, wherein the sealing ring is constructed from one or more of elastomeric, thermoplastic and graphitic materials.

* * * * *